US010165808B2

(12) United States Patent
Fallon

(10) Patent No.: US 10,165,808 B2
(45) Date of Patent: Jan. 1, 2019

(54) SUPREMELY ADJUSTABLE FACIAL MASK

(71) Applicant: Deirdre Fallon, Breckenridge, CO (US)

(72) Inventor: Deirdre Fallon, Breckenridge, CO (US)

( * ) Notice: Subject to any disclaimer, the term of this patent is extended or adjusted under 35 U.S.C. 154(b) by 136 days.

(21) Appl. No.: 14/934,500

(22) Filed: Nov. 6, 2015

(65) Prior Publication Data

US 2016/0128398 A1 May 12, 2016

Related U.S. Application Data

(60) Provisional application No. 62/075,992, filed on Nov. 6, 2014.

(51) Int. Cl.

| | |
|---|---|
| ***A42B 1/00*** | (2006.01) |
| ***A42B 1/04*** | (2006.01) |
| ***A41D 13/11*** | (2006.01) |

(52) U.S. Cl.

CPC ..... *A41D 13/11* (2013.01); *A42B 1/006* (2013.01); *A42B 1/046* (2013.01)

(58) Field of Classification Search

CPC ..... A41D 13/11; A42B 1/006; A42B 1/046

USPC ..... 2/206

See application file for complete search history.

(56) References Cited

U.S. PATENT DOCUMENTS

| | | | | |
|---|---|---|---|---|
| 5,765,230 A * | 6/1998 | Sivret | A42B 1/046 2/202 |
| 5,822,800 A * | 10/1998 | Anderson | A42B 1/041 2/171 |
| 5,832,538 A * | 11/1998 | Williams | A42B 1/067 2/172 |
| 7,096,511 B2 * | 8/2006 | Cohen | A41D 15/00 2/206 |
| D692,186 S | 10/2013 | Phillips | |
| 2003/0145858 A1 * | 8/2003 | Cardarelli | A61F 9/045 128/206.22 |

OTHER PUBLICATIONS

Product brochure for "Wood Grain Ski Mask" by Beardo , accessed at http://www.beardowear.com/products/wood-grain-ski-mask-hd on Nov. 4, 2015. Publication date and author unknown.

Product brochure for "Beardo Original" by Beardo , accessed at http://www.beardowear.com/products/beard-hat-grey on Nov. 4, 2015. Publication date and author unknown.

Product brochure for "Airhood Polar," by Airhole Facemasks Inc., accessed at http://airholeusa.myshopify.com/products/airhood-polar, Nov. 4, 2015. Publication date and author unknown.

* cited by examiner

*Primary Examiner* — Timothy K Trieu

(57) ABSTRACT

The invention is a supremely adjustable face mask. Moveable elements can be easily raised or lowered by the wearer to selectively cover different parts of the face in order to adapt to changing climate or social conditions. The garment is advantageously manufactured as a simple sleeve with accessory bands and cutouts placed so as to create adjustable coverings when the garment is worn.

3 Claims, 5 Drawing Sheets

SUPREMELY ADJUSTABLE FACIAL MASK

CROSS-REFERENCE TO RELATED APPLICATIONS

This application claims the benefit of U.S. Provisional Application No. 62/075,992, filed Nov. 6, 2014 and which is hereby incorporated by reference, in its entirety.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not Applicable

BACKGROUND AND SUMMARY OF THE INVENTION

At work or at play, persons often spend extended amounts of time outdoors. From farmers to mountain bikers, all manner of people are regularly exposed to the elements, including sun, wind, and cold. Jackets, shirts, pants, gloves and footwear for protection from the elements are widely available, often tailored to individual activities. For protection of the face, there are less options. Hats with big brims are typically used to protect the face from the elements, but such hats do not directly cover the face, and the user's face is subjected to wind, cold, reflected light coming in laterally or from below. Many activities, such as biking and skiing, do not lend themselves to headwear with a large brim, subjecting the user's face to significant UV, wind, and cold stresses.

For some individuals, UV protection is a major concern. Persons with skin damage, persons at risk for or having skin cancer, or persons that have been photosensitized due to medication may require facial UV protection when outdoors to protect skin. Likewise, many persons concerned with aging or stressful effects of UV radiation may seek thorough facial protection.

Various face coverings are known in the art, which provide direct covering of some or all of the face. For example, the standard "buff" is one garment, basically comprising a sleeve, that can be pulled around much of the face and neck to provide some level of protection. Adaptations of the buff, such as the BEARDO™ or AIRHOLE™ faces masks, have portals around the mouth or nose area and add breathability to the standard buff concept. Other less common designs are known which comprise flexible masks and coverings having a wide variety of shapes and forms. However, these prior art designs suffer from limited adjustability.

Adjustability is critical in a facial covering to aid the user in dealing with changing conditions As any outdoors person has experienced, climate conditions are constantly shifting, including changing levels of sunlight, wind, and temperature. Social conditions also change rapidly, and user may wish to have their face thoroughly covered when alone or not socializing and then to quickly uncover their face when interacting with others.

Accordingly, there is a need in the art for a highly adjustable facial covering that can provide a range of coverage, from full facial coverage to limited coverage, in response to changing conditions and which can be quickly and readily adjusted. It would be advantageous if such a garment can be easily manufactured and is amenable to being made out of a variety of materials to provide a wide range of form and function.

Provided herein is a novel facial covering garment which is highly adjustable, yet retains simplicity in form and manufacturing, comprising just three pieces of fabric or less. The novel facial covering garment of the invention advantageously provides a higher level of adjustability than prior art systems, while retaining a simple, adaptable design which is amenable to use with a variety of fabrics.

BRIEF DESCRIPTION OF THE DRAWINGS

FIG. 1A depicts a frontal view of an exemplary garment of the invention.

FIG. 1B depicts a side view of the garment depicted in 1A.

FIG. 2A, 2B, 2C, and 2D depict an exemplary garment of the invention in various configurations. In FIG. 2A, the headband is on the user's head and the chin band, philtrum band, and nose band are down. In FIG. 2B, the chin band is pulled up to cover the users chin. In FIG. 2C, the philtrum band is pulled up to cover the philtrum. In FIG. 2D, the nose band is pulled up to cover the user's nose.

DETAILED DESCRIPTION OF THE INVENTION

Garment Overview. The garment of the invention provides unprecedented levels of adjustability, allowing the user to quickly and selectively cover and uncover various facial features with ease.

To aid in the description of the invention, reference is made to FIG. 1A, 1B, 2A, 2B, 2C, and 2D. The orientation of elements in the Figures will be described by axes relative to the user, with top-to-bottom being from the top of the user's head downwards and front-to-back being from the user's face back towards the rear of the user's head.

Figure 1B:
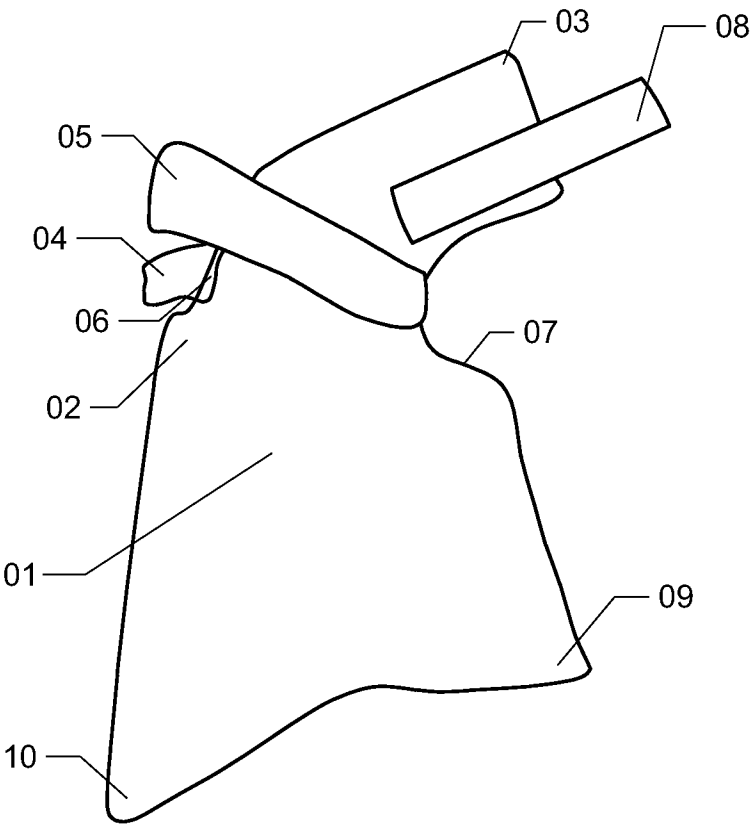
FIG. 1A and FIG. 1B.
Figure 1A:
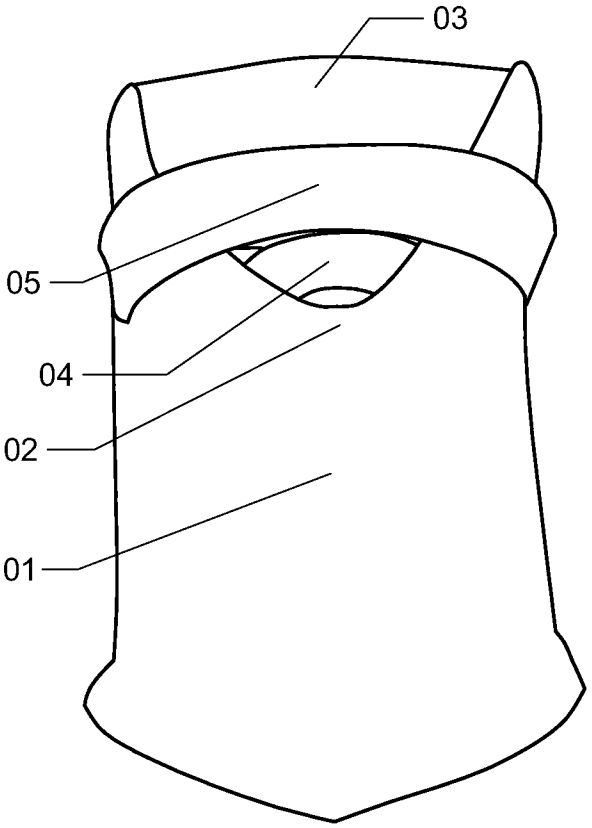

Referring to FIG. 1A and 1B, the garment comprises a body element (01). The body element is substantially tubular. The tubular body may be tapered, being narrower at the top and wider at the bottom. The top and bottom openings may be angled, sloping downwards from back to front, from the back central point (03) to the chin section (02), the thin section being the top front edge of the tubular body. The body of the garment may comprise various features.

A first feature of the garment is a rear cutout (07), creating a crown band (03). The rear cutout is such that the top, rear section of the body acts as an independently moveable band, herein referred to a crown band, as, in many configurations, it rests on the crown or top of the user's head. The crown band has freedom of movement and can be positioned forward, towards the forehead or backwards, resting on the back of the user's head. The crown band may also be pulled down below the face, typically on the back side of the head. The cutout creates the crown band, and also imparts its moveability. The cutout also provides long-haired individuals a portal for their hair to protrude from the garment, while remaining configured in a pony tail or other hairstyle. In an alternative embodiment, the tubular body has no rear cutout, and the crown band is formed by a separate piece of fabric or other material, for example a substantially rectangular piece of fabric, such band being sewn so that the band arcs from side to side over the open top of the tubular body.

A second feature of the garment is what will be termed the "philtrum band" (04) One's philtrum is the vertical groove that runs from the top of the upper lip to the bottom of the nose. The philtrum band of the garment of the invention is a band of material that arcs across the top of the chin section (02), creating an archway opening below it. The philtrum band can be positioned such that it covers the upper lip and surrounding skin while the archway opening can be positioned above the mouth to facilitate breathing and speaking. Mouth holes in buffs and such are known in the prior art. However, the philtrum band is not merely a cutout at the expected position of the user's mouth. Rather, it has extra length, such that it be effectively and comfortably positioned on the upper lip. The philtrum band may be stitched or otherwise attached to the edges of the body 06 or may be connected further back from the edge of the body sleeve to impart greater range of movement. While the philtrum band may be configured as a rectangular band, in a preferred configuration it has a central, downward indentation, or "bowtie" configuration, such that it fits below the nose in the center of the face and angles up to protect the lower cheeks.

A third feature is the nose band (05). The nose band is a substantially rectangular band, preferably fastened rearward, for example at or near the back of the body, for example, having an attachment point at the edge of the rear cutout, behind and below the ear lobe. The length of the band aids in its adjustability, allowing the band to be moved up and down, covering the nose in the upper, deployed position, while resting below the chin when in the downward position, not deployed.

An optional fourth feature is a rear headband (08). The rear headband is a substantially rectangular or oblong piece of fabric connected to the body, for example at an attachment point above that of the noseband. The rear headband provides stability to the garment, holding it in place.

Figure 2A:
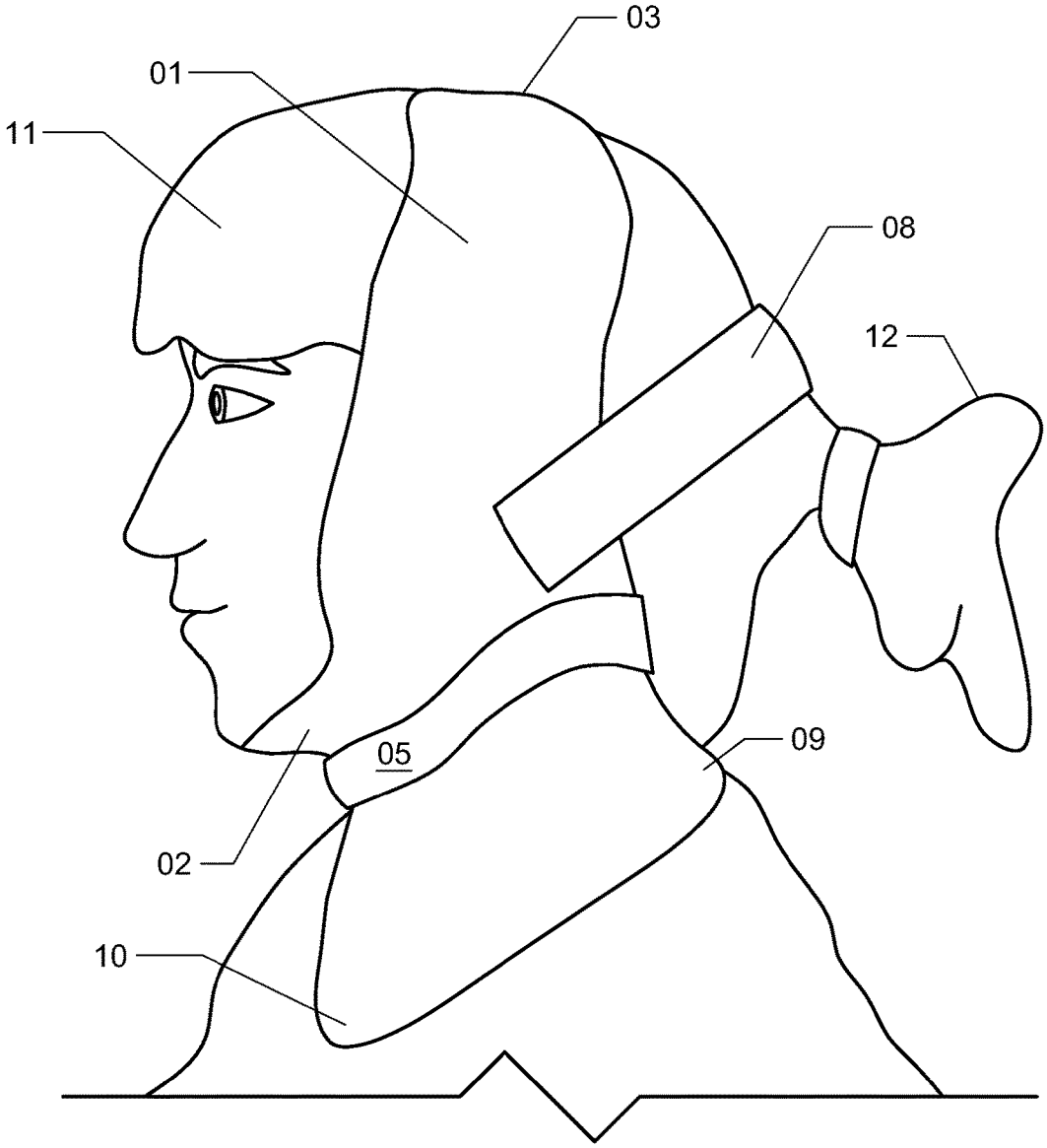
FIG. 2A, 2B, 2C, and 2D.

Reference is next made to FIG. 2A, FIG. 2B, FIG. 2C, and FIG. 2D, which depict an exemplary garment of the invention in various configurations. In FIG. 2A, the user (11) has the crown band (03) over their head and the rear headband (08) holding the garment in place. The cutout allows the user's pony tail (12) to comfortably protrude from the back of the garment. The sloping cut of the bottom of the body (01) creates an angled garment that slopes down from the back of the neck (09) to the upper chest of the user (10). In FIG. 1A, the chin section (02) is pulled down. In FIG. 2A, the philtrum band is attached to the inner edges of the body (01) so that it may be pushed down and tucked into the body and is obscured by the chin section (02). In FIG. 2A, and the nose band (05) is pulled down. In the configuration of 2A, the user's face is largely unprotected, but is well ventilated and the user is able to eat, drink, and socialize uncovered.

Figure 2B:
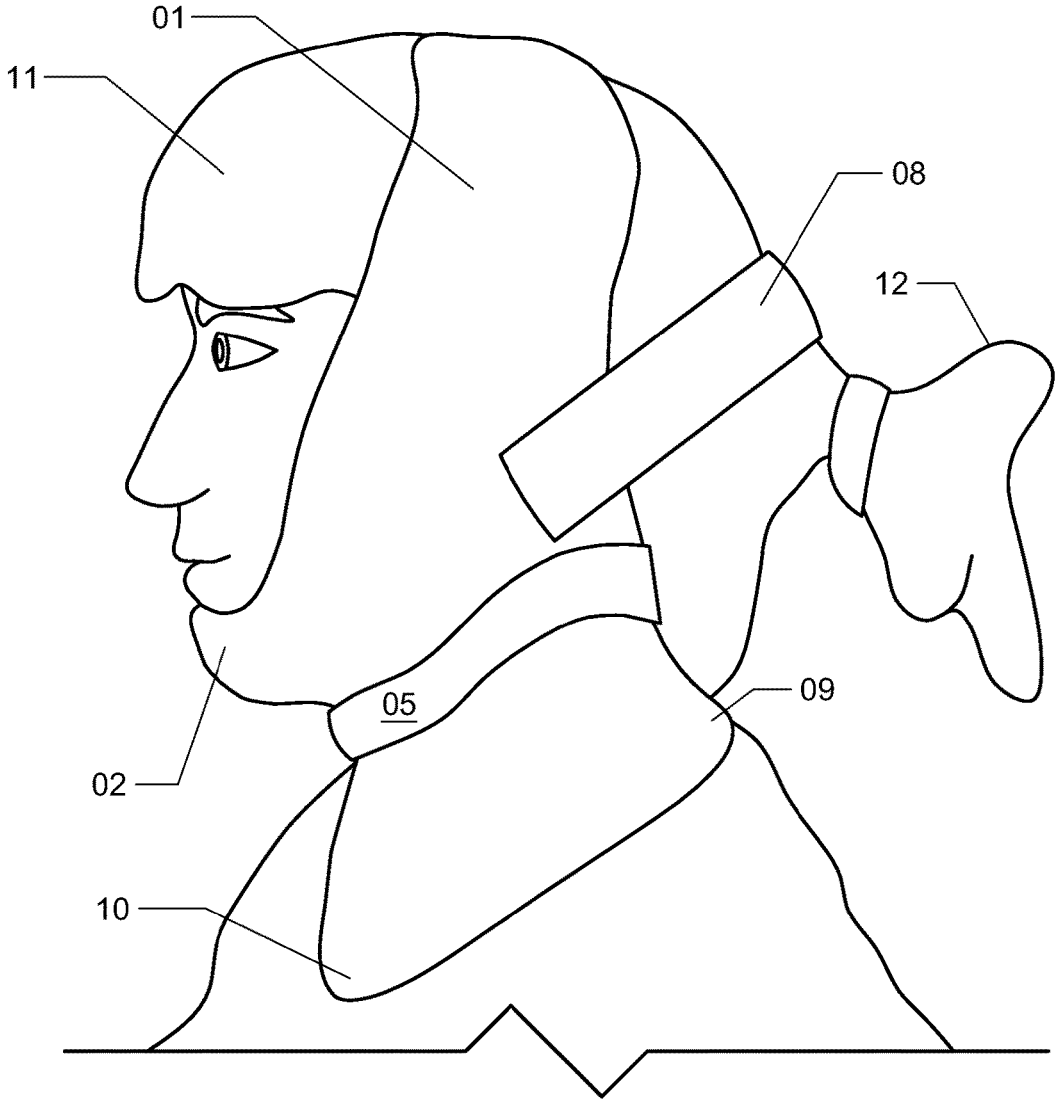

In FIG. 2B, the chin section (02) has been pulled up over the user's chin. This draws the front edge of the garment body (01) forward, covering some of the user's cheeks.

Figure 2C:
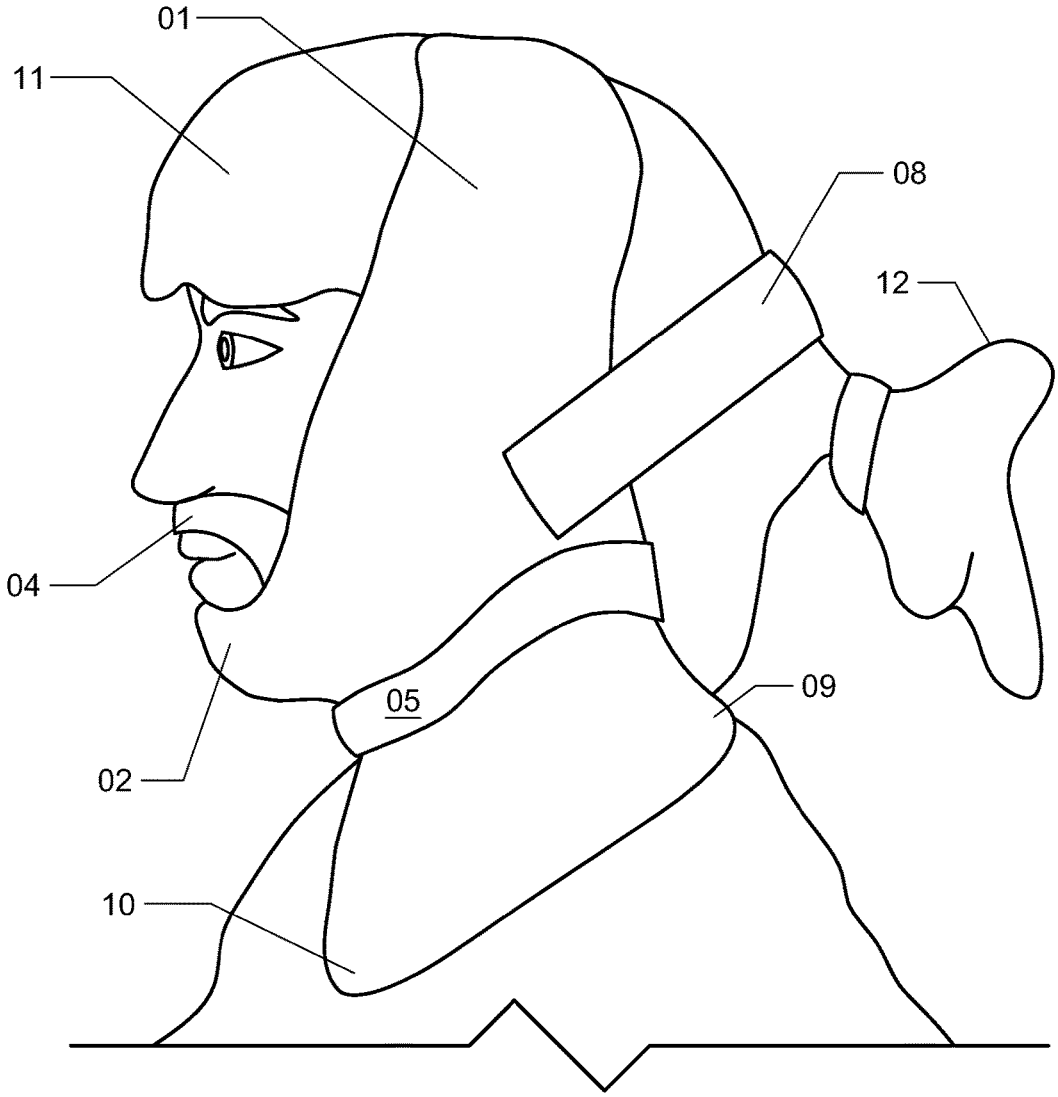
Figure 2D:
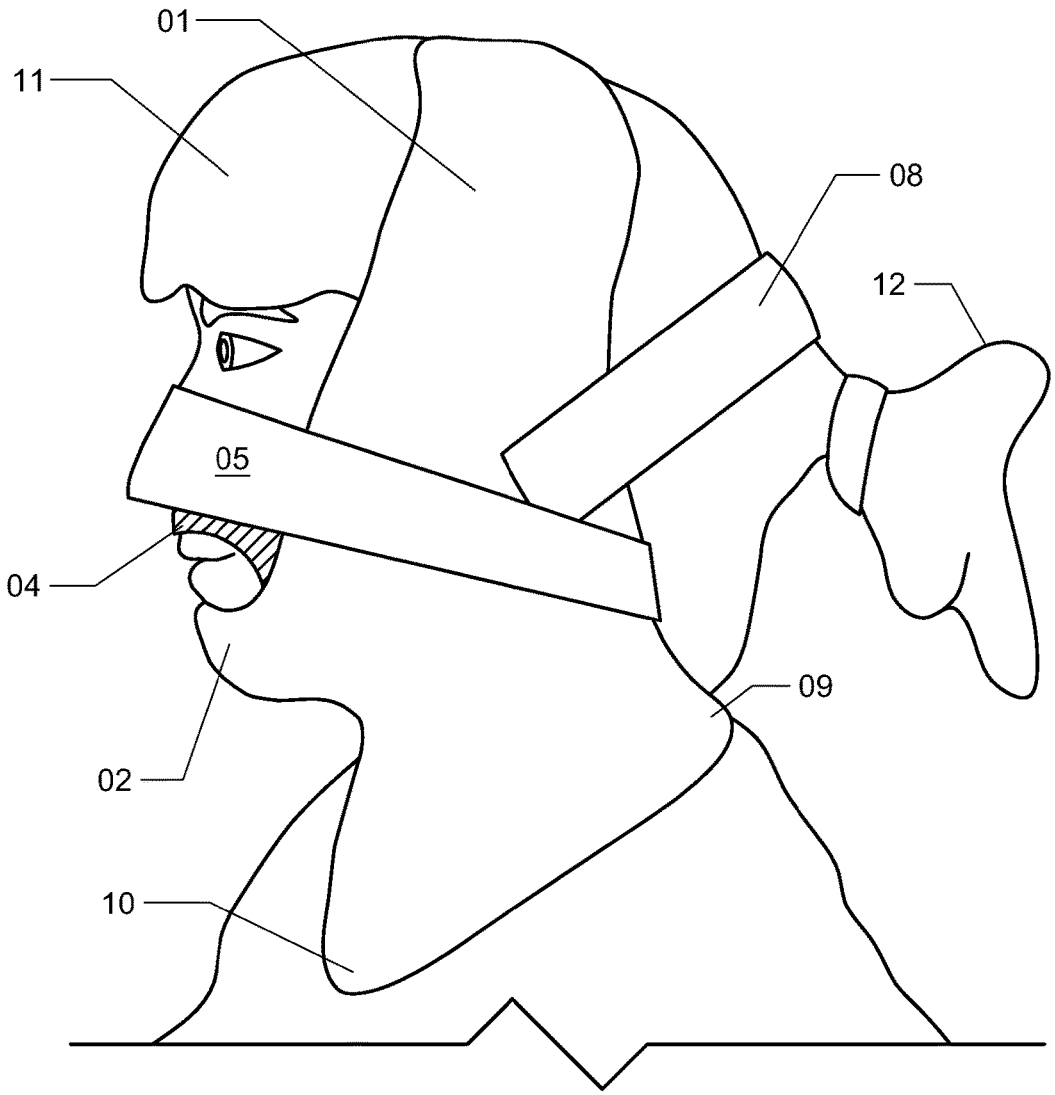

In FIG. 2C, the philtrum band (04) has been pulled up and is deployed in an arc across the user's philtrum, sides of the mouth, and some of the cheeks In FIG. 2D, the nose band (05) has been pulled up to cover the user's nose and more of the user's cheeks. In this configuration, the user is largely protected from the elements. The chin section (02) may also be pulled up further, or the philtrum band can be pulled lower, to cover and protect the user's lips.

The garment of the invention may be made of any fabric. Preferably the garment is made with a stretchy, flexible material, such as a knit material which has at least some degree of "give" or elasticity, allowing it to conform to the contours of the user's face while the moveable elements of the crown band, philtrum band, and nose band are positioned in various configurations. For example, as known in the art, knit fabrics have an inherent elasticity, as do fabric made from knit fibers. Exemplary fabrics of the garment of the invention include cotton, hemp, linen, silk, polyester, nylon, rayon, and other fabrics known in the art. The philtrum band and nose band elements of the invention are preferably stitched to the body, however other attachment structures such as grommets, rivets, buttons or other fasteners may be used. The fasteners of the invention may be permanent or non-permanent, for example, allowing the optional removal of the philtrum band and/or nose band, or the customization of the garment by selection of philtrum bands and/or nose bands having proportions sized to the users face or other selected properties.

The garment may comprise a single fabric, or different types of fabric layered or connected (e.g. sewn) together. For example, for cold weather use, the garment may comprise a soft, insulating layer on the inside surface and a water resistant or wind resistant outer layer. In another embodiment, for example for hot weather use, the crown band, and rear head band, if present, may comprise a mesh or other well ventilated fabric or a thin material that is meant to be comfortably worn under a hat or other head gear.

For UV protection, the garment preferably comprises a fabric that substantially blocks the transmission of UV radiation. In some embodiments, the garment of the invention comprises a UV-blocking fiber or a fiber which has been coated with a UV-blocking material, such as chitosan, zinc oxide nanoparticles, titanium dioxide nanoparticles, or other UV coatings for fabrics as known in the art.

The garments of the invention may optionally be printed, embossed, embroidered, adorned, or otherwise decorated with artwork, logos, and branding materials.

The invention further encompasses methods of using the garments disclosed herein. For example, in one embodiment, the garments are worn with a helmet, hat, or other headgear and are optionally used with eyewear such as sunglasses or goggles. In another embodiment, the garment of the invention is wetted such that it provides an evaporative surface, cooling the face in hot weather. In another embodiment, for use in cold weather, the garment includes heating elements, such as battery powered heating filaments, or pockets for the insertion of iron oxide-based heating pouches.

All patents, patent applications, and publications cited in this specification are herein incorporated by reference to the same extent as if each independent patent application, or publication was specifically and individually indicated to be incorporated by reference. The disclosed embodiments are presented for purposes of illustration and not limitation. While the invention has been described with reference to the described embodiments thereof, it will be appreciated by those of skill in the art that modifications can be made to the structure and elements of the invention without departing from the spirit and scope of the invention as a whole.

The invention claimed is:

1. An adjustable facial garment comprising a body comprising a tubular shape extending from front-to-back and upper-to-lower portions with respect to the front to the back of a user's head and from the upper to the lower portion of a user's head; a crown band, wherein the crown band is created by a cutout region in the top upper section of the body; a nose band, wherein the nose band is rectangular band; wherein the nose band comprises two ends, and wherein each end is attached to the rearward side of the body; and wherein the nose band is configured for covering the user's nose while leaving the user's mouth uncovered; and a philtrum band; wherein the philtrum band comprises two ends and wherein each end is attached on the front side of the body; and wherein the philtrum band is configured for covering the user's philtrum while leaving the user's mouth uncovered.

2. The garment of claim 1, further comprising a rear head band.

3. A method of selectively covering portions of the face, wherein a user wears a garment comprising a body comprising a tubular shape extending from front-to-back and upper-to-lower portions with respect to the front to the back of a user's head and from the upper to the lower portion of a user's head;

a crown band, wherein the crown band is created by a cutout region in the top upper section of the body;

a nose band, wherein the nose band is rectangular band; wherein the nose band comprises two ends, and wherein each end is attached to the rearward side of the body; and wherein the nose band is configured for covering the user's nose while leaving the user's mouth uncovered; and aphiltrum band; wherein the philtrum band comprises two ends and wherein each end is attached on the front side of the body; and wherein the philtrum band is configured for covering the user's philtrum while leaving the user's mouth uncovered; and wherein the nose band is raised to cover the user's nose and the philtrum band is raised to cover the user's philtrum.

* * * * *